US005340965A

United States Patent [19]

Horbal et al.

[11] Patent Number: 5,340,965

[45] Date of Patent: Aug. 23, 1994

[54] MECHANICAL POSTAGE METER RESETTING DEVICE AND METHOD

[75] Inventors: John J. Horbal, Beacon Falls; James S. Emmett, Derby, both of Conn.

[73] Assignee: Ascom Hasler Mailing Systems, Inc., Shelton, Conn.

[21] Appl. No.: 841,893

[22] Filed: Feb. 25, 1992

Related U.S. Application Data

[63] Continuation of Ser. No. 333,993, Apr. 5, 1989, abandoned.

[51] Int. Cl.[5] ..... G07G 1/00

[52] U.S. Cl. ..... 235/101; 364/464.02

[58] Field of Search ..... 235/101; 364/464.02

[56] References Cited

U.S. PATENT DOCUMENTS

| | | | |
|---|---|---|---|
| 3,034,329 | 5/1962 | Pitney et al. . | |
| 3,194,946 | 7/1965 | Rabinow . | |
| 3,255,439 | 6/1966 | Simjian . | |
| 3,428,948 | 2/1969 | Simjian . | |
| 3,501,744 | 3/1970 | Simjian | 235/101 |
| 3,596,247 | 7/1971 | Eckert . | |
| 3,664,231 | 5/1972 | Hanson . | |
| 3,792,446 | 2/1974 | McFiggins et al. . | |
| 3,965,815 | 6/1976 | Lupkas et al. | 101/91 |
| 4,050,374 | 9/1977 | Check, Jr. | 101/91 |
| 4,097,923 | 6/1978 | Eckert, Jr. et al. | 364/900 |
| 4,119,161 | 10/1978 | Price et al. | 235/101 X |
| 4,121,473 | 10/1978 | Schubert et al. | 235/101 X |
| 4,135,377 | 1/1979 | Kleefeldt et al. | 70/264 |
| 4,202,489 | 5/1980 | Schubert | 235/101 |
| 4,218,011 | 8/1980 | Simjian | 235/375 |
| 4,222,518 | 9/1980 | Simjian | 235/375 |
| 4,226,360 | 10/1980 | Simjian | 235/375 |
| 4,249,071 | 2/1981 | Simjian | 235/375 |
| 4,268,817 | 5/1981 | Simjian . | |
| 4,427,969 | 1/1984 | Coppola et al. | 235/101 X |
| 4,519,048 | 5/1985 | Abellana et al. | 235/101 X |
| 4,547,853 | 10/1985 | Eckert | 364/464.02 |
| 4,621,719 | 11/1986 | Kittredge | 194/48.1 |
| 4,658,722 | 4/1987 | Muller | 101/110 |
| 4,807,139 | 2/1989 | Liechti | 364/464.02 |

FOREIGN PATENT DOCUMENTS 2166389 5/1986 United Kingdom .

*Primary Examiner*—Michael L. Gellner
*Assistant Examiner*—Eddie C. Lee
*Attorney, Agent, or Firm*—Brumbaugh Graves Donohue & Raymond

[57] ABSTRACT

A postage meter resetting apparatus includes a stepper motor as a first motive arrangement for turning the resetting shaft of a mechanical postage meter, another stepper motor as a second motive mechanism to enable or disable resetting by the first stepper motor. A lead screw, lead nut and linkage, driven by the second stepper motor, when resetting is authorized, moves an axially movable part of a coupling between the second stepper motor and the meter's axially movable resetting shaft, to bring the resetting gear on the shaft into engagement with a gear of the meter's descending register. An input to the first stepper motor, representing a variable amount of postage, effects turning of the resetting shaft and the engaged gears by amounts corresponding to the desired variable amount of postage to be added to the meter's descending register. An encoder coupled to the shaft of the first stepper motor provides an output indication of the amount that the shaft has turned. A CPU routine assures that the gear on the meter's resetting shaft has cleared a blocking pin and engaged the descending register gear prior to resetting by the first stepper motor. Another CPU routine clears jams when it is detected that the shaft has not been turned the amount desired.

23 Claims, 4 Drawing Sheets

MECHANICAL POSTAGE METER RESETTING DEVICE AND METHOD

This application is a continuation of application Ser. No. 07/333,993, filed on Apr. 5, 1989, abandoned.

BACKGROUND OF THE INVENTION

This invention relates to a remote resetting mechanical postage meter and more particularly to a mechanical postage meter with an electromechanical resetting unit that makes available additional postage from the meter when authorized to do so.

Postage meters have been proposed that avoid the necessity of being taken to the Post Office for resetting. Early proposals used mechanical combination locks having predetermined combinations that changed with each resetting. The combinations stored in the meter were known to a central authority with a "data center", but not to the user. If the data center approved the introduction of a fixed amount of additional postage, it advised the user of the next combination. The user would enter the next combination, and the meter would be reset by adding the fixed postage amount to the descending register total. In meters of this kind punched tapes were sometimes suggested as the means for storing the fixed series of combinations. For meters that use the punched tape storage of the sequence of combinations known only to the data center, telephone communication from the data center of a combination identical to the next of a stored, fixed series of combinations in the meter has been suggested, to enable resetting the meter with a fixed amount of postage. In at least one instance, it was suggested that the code transmitted by telephone be a series of pulses of different frequency to be compared with spaces and punched marks in a tape. Each correct comparison of a mark on a space would advance the tape a step, and after ten advanced steps, the corresponding movement would be applied to the meter's mechanical descending register.

The art has also described electronic meters, which is to say any meters with electronic registers, capable of being reset by the user's introduction of a one time only combination. For resetting these meters with a variable amount of postage, a central computer of an authorizing authority generates the combination based on either the amount of postage requested or the number of resets of the pertinent meter or both. The combination is then given to the user by telephone to enable resetting.

SUMMARY OF THE INVENTION

In accordance with this invention, a mechanical meter setting device suitable for use with a mechanical postage meter, i.e. a meter with a mechanical descending register, includes a first motor, or other motive means, for turning the mechanical descending register resetting provisions to increase the amount of postage available from the meter, and another motor, or other motive means, for enabling the first motive means to effect the resetting. More particularly, a first stepper motor and control electronics provide the precise turning of a shaft that resets the descending register, while a second stepper motor, its control electronics, and a linkage driven by it move the resetting shaft into and out of resetting relation with the descending register to enable resetting. In the particular preferred embodiment, the second stepper motor and linkage moves the resetting shaft of the meter axially to move a resetting gear on the resetting shaft out of engagement with a fixed blocking member or pin and into engagement with a gear of the descending register that is used to increase the value on the descending register.

When used for remote resetting, the enabling second motor is activated by its electronics when a central processing unit (CPU) approves resetting (for example upon recognizing a combination) and authorizes resetting. Activation of the enabling motor couples the first motor and the resetting provisions of the descending register by the axial movement of the resetting shaft. The first resetting stepper motor is then energized to turn an amount that represents the value of requested postage.

An axially movable coupling permits movement of the resetting shaft without decoupling the resetting shaft from the output shaft of the first stepper motor. The axially movable coupling, which is secured to the resetting shaft, carries a bushing between shoulders formed on the coupling. The coupling is rotatable within the bushing. The linkage driven by the second stepper motor can be a pivotal arm, or pair of arms, connected to the bushing, pivotally supported at a fulcrum, and pivoted by the second stepper motor. Preferably a lead screw, carrying a lead screw nut, connected to the pivotal arm or arms, is operated by the second stepper motor to drive the linkage and move the resetting shaft. The gear carried on the resetting shaft, when retracted from the descending register resetting gear, once again engages the rotation preventing blocking member or pin and is locked.

The CPU for the resetting device contains a program routine that determines when the resetting shaft gear is correctly located for resetting. First, the second stepper motor is activated, but insufficiently to cause the shaft to move far enough axially to move the gear out of engagement with the rotation blocking pin. The first stepper motor is pulsed a number of times that corresponds with a small rotational movement, but greater than can be accomplished, because of the continued engagement of the gear with the rotation blocking pin. An encoder coupled to the shaft of the first stepper supplies information to the CPU indicating how far the shaft actually turned. The CPU determines that the first motor did not accomplish the rotation called for by the input to the motor. Another input is directed to the second stepper motor, moving the linkage farther, and then the first stepper motor is pulsed as before. This is continued until the amount of rotation indicated by the. encoder corresponds to the input to the first stepper motor. At that time it is clear that the gear has moved out of engagement with the rotation blocking pin and is engaged with the resetting gear on the descending register. An additional input is directed to the second stepper motor to assure a minimum clearance exists between the gear and the rotation blocking pin. Sufficient pulses are now supplied to the first stepper to set into the descending register the desired amount of postage. The control electronics retains the total amount the second, enabling motor has moved throughout the several movements toward gear engagement and now drives the motor a like amount in the gear withdrawal direction.

Another routine of the CPU of the resetting device detects and clears jams that may occur by the resetting shaft moving too little axially or too far. The number of steps that the first stepper motor has been instructed to turn in resetting the descending register is compared with the actual steps accomplished as indicated by the encoder. If less than complete turning has been accomplished, this indicates jamming and begins the corrective routine. The second, enabling, stepper motor is caused to turn a number of steps in one direction. The first stepper motor is then directed to turn a number of steps and the encoder output is compared. If the commanded turning conforms to the detected turning, the jam is declared freed. If not, however, the second motor is turned twice its previous number of steps in the opposite direction, the first motor is again commanded to turn and the accomplished turning is compared. If the comparison is still unsuccessful, then three times the previous rotation of the second stepper motor is commanded with the direction again reversed. The comparison is made and the process is continued with greater turning in each direction until the jam is cleared or until a chosen cutoff number of axial movements at which the jam is declared hopeless and the resetting is aborted.

After jamming has been cleared additional inputs are sent by the CPU to the first stepper motor representing the number of steps needed to complete the resetting. On the assumption that axial movement by the second stepper motor, did not correspond to the instructions (number of steps) given the motor, a corrective routine is employed. The resetting shaft is retracted sufficiently to engage its gear with the blocking pin and the gear is then moved toward disengagement with the pin as in the gear to gear engaging routine previously described. The rotational check for disengagement is made, and when it is determined that the resetting gear is clear of the pin, the gear is retracted back onto the pin by movement of the shaft the amount previously determined to be the amount that moves the gear onto and off of the pin in the routine used for locating the gear for resetting as described above.

The amount of axial movement to be used in the next resetting is updated by an amount of movement related to that which was necessary to clear the jam, stored as a change in the minimum clearance added after the gear has been found to be free of the rotation blocking pin.

BRIEF DESCRIPTION OF THE DRAWINGS

The above and further features and advantages of the invention will be better understood with respect to the following detailed description of a preferred embodiment, taken in combination with the several figures of the associated drawings, in which.

DETAILED DESCRIPTION OF THE PREFERRED EMBODIMENT

Figure 1:
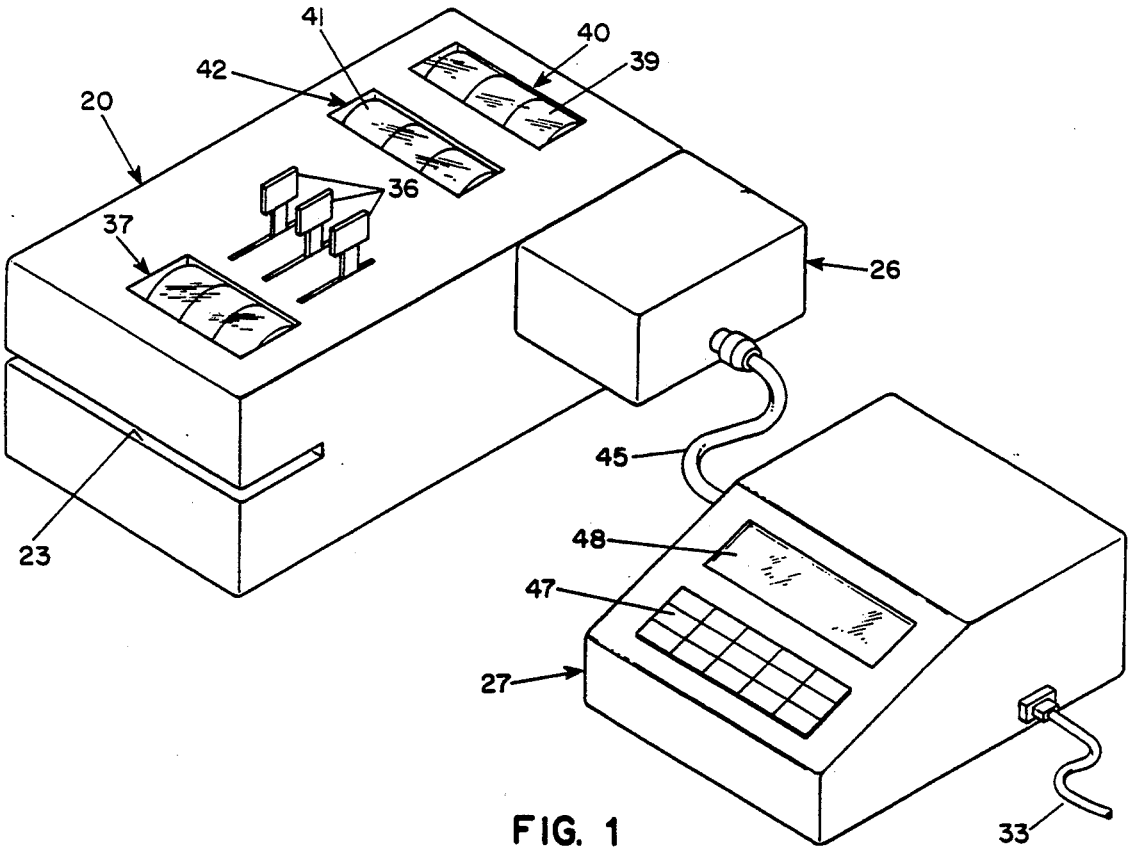
FIG. 1 is a diagrammatic perspective view of a postage meter having a resetting device attached and including a communications unit.

A postage meter 20 appears in FIG. 1. Levers 36 extending into slots in the face of the meter are the means for setting the postage to be printed. The postage that has been set for printing is visible on a register seen through a window as indicated at 37. Passing a piece of mail through a slot 23 activates a postage printer in the meter to apply the selected amount of postage to the piece of mail. Each application of postage in this fashion decrements a mechanical descending register 39 visible through a window 40. The value appearing on the descending register 39 is the value of postage still available to be printed by the meter 20. A running total of the postage printed can be seen on a mechanical ascending register 41 that is visible through a second window 42. All of the above is conventional.

The meter 20 is a mechanical meter, by which is meant a meter having mechanical ascending and descending registers as shown. Other mechanical meters have electronic postage setting means such as a keypad, microprocessor, and display, but remain mechanical meters because the ascending and descending registers are mechanical. As will be seen, this invention relates only to mechanical meters. In an electronic meter the ascending and descending registers are electronic.

In accordance with this invention, a "meter unit" 26 is the resetting device that makes possible resetting of the meter without carrying the meter to the post office. The meter unit 26 is physically attached to the meter 20 at the location of the entry door where manual resetting is ordinarily accomplished by a postal employee. An interlock incapacitates the meter if the resetting device 26 is removed without authority. Electrically connected to the resetting device 26, as by a cord 45, a communications unit 27 is, in this case, a separately enclosed unit with a keypad 47 and an LCD display 48. The communications unit 27 is used to request, from a central computer or "host", resetting of the meter 20 with additional postage. The user enters identifying data at the keypad 47 as well as the amount of additional postage requested. The LCD display 48 prompts the user and indicates the status of the resetting operation. Via its telephone line 33, the communications unit 27 communicates with a central authorizing facility or host. The host verifies the availability of funds and authorizes resetting in a secure fashion. The communications unit 27, the host, and the manner of secure communication between them are not part of this invention, which relates to the means and manner of effecting resetting once authorization has been received.

Figure 2:
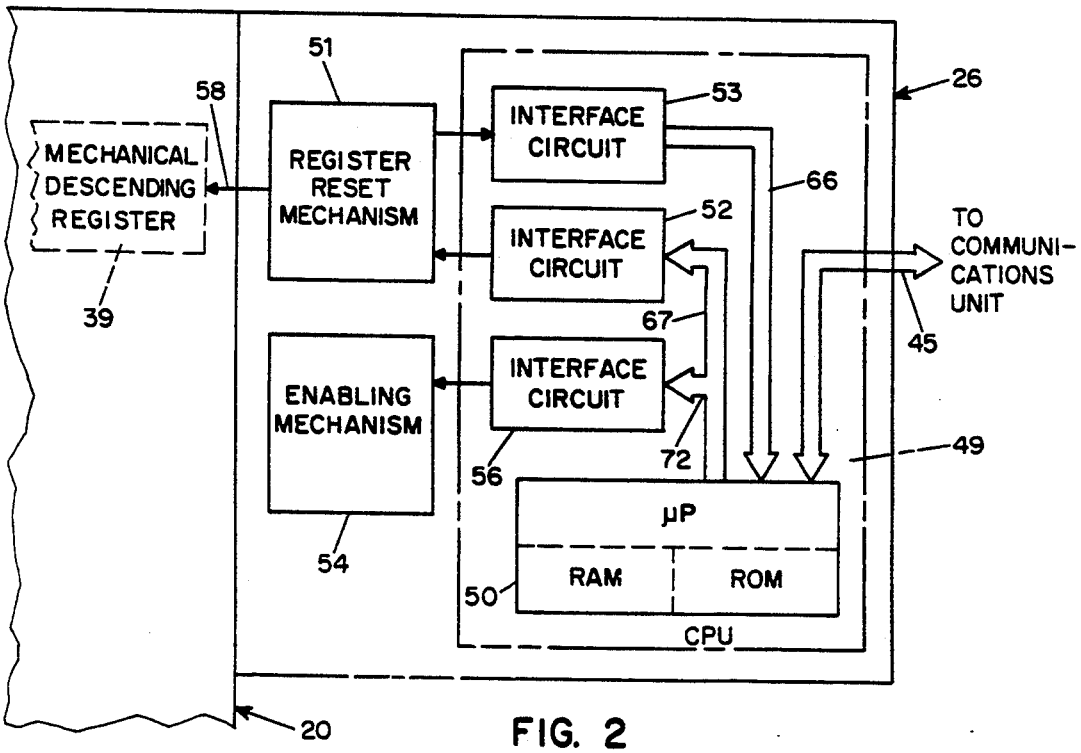
FIG. 2 is a diagrammatic illustration in block diagram form of the major components of the meter resetting device illustrated in FIG. 1.

Relevant portions of the meter and its resetting device are illustrated in FIG. 2 in block diagram form. The meter resetting device or meter unit 26 has electronics 49 that include a CPU 50. The CPU may include a microprocessor, random access memory, and read only memory. It is in communication with the communications unit 27 of FIG. 1 via the cable 45. A register reset device or mechanism 51 connects with the CPU 50 of the meter unit via such interface circuits 52 and 53 as required. An enabling device 54 receives instructions from the CPU 50 via such interface circuit 56 as it may require. This mechanism 54 enables the register reset device 51 when appropriate. An output 58 from the register reset mechanism 51 is a mechanical output to increase the available postage in the mechanical descending register 39 of a postage meter.

The communications unit 27 of FIG. 1 is responsible for communicating with the remote host computer by modem, receiving information from the user via the keypad 47, providing information to the user via the display 48, and forwarding information to the meter unit 26. The CPU 50 causes the descending register 39 to be reset when it receives an appropriate authorizing input such as a combination that it recognizes as appropriate. The CPU 50 receives the value of the variable amount of postage requested from the communications unit, where the user has input this value at the key pad 47. When it has received an authorization input that it recognizes as valid, the CPU 50 begins the routine that will, first, enable resetting, second, add into the descending register the desired value of additional postage, and third, disable further resetting.

Figure 3:
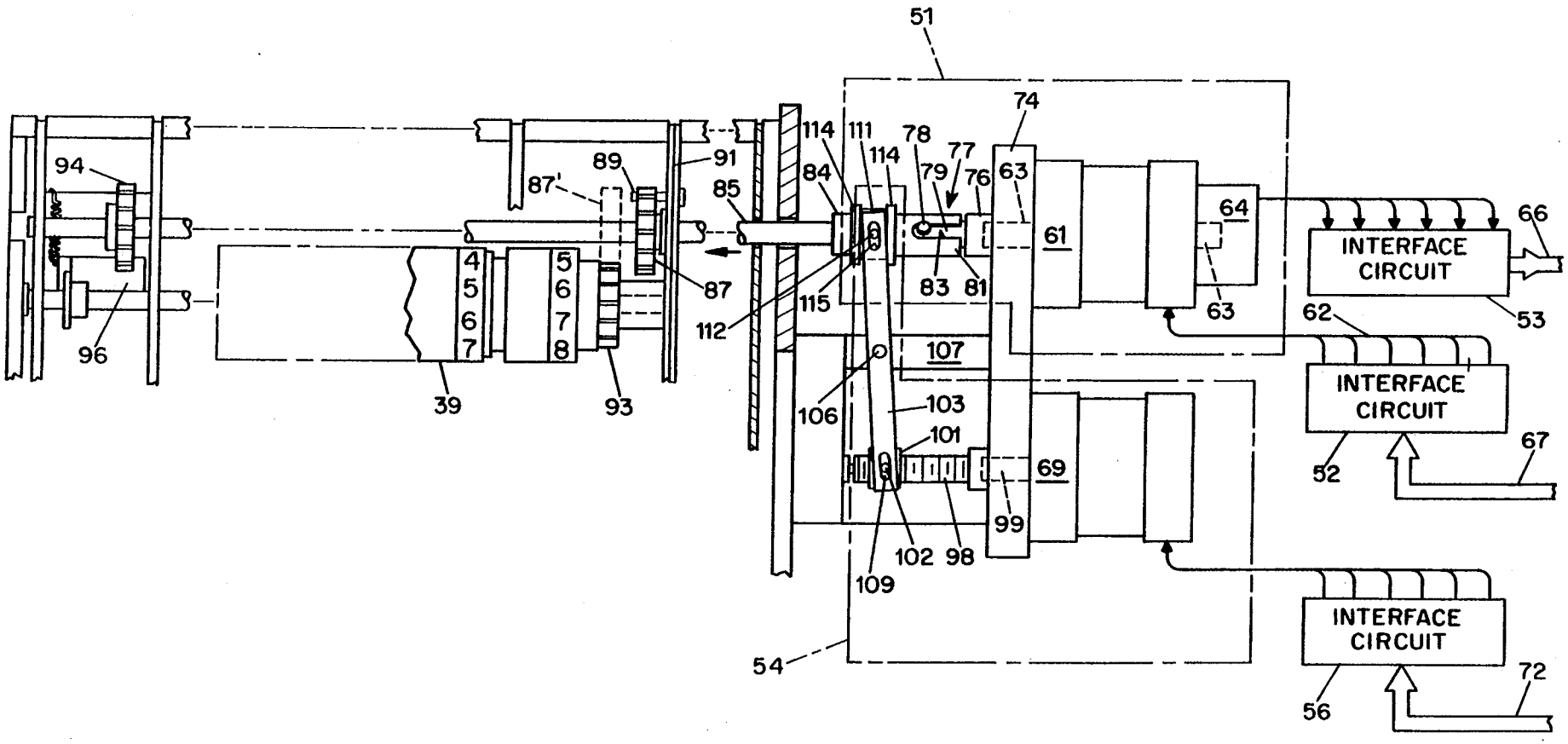
FIG. 3 is a fragmentary plan view of a portion of the meter of FIG. 1, the mechanical components of the resetting device and, in block diagram form, circuitry associated with stepper motors and an encoder of the resetting device.

The relationship of the resetting mechanism 51 and the enabling mechanism 54 is shown in FIG. 3 in association with the mechanical descending register 39. The resetting mechanism 51 includes a stepper motor 61. The interface circuit 52 is its commercially available control circuit. This circuit converts inputs, on lines 67, from the CPU 50, or an intermediate register, if needed, and converts them to stepping motor inputs to the motor on line 62, to control the amount of rotation of the motor. An encoder 64 is part of the resetting mechanism 51. Its commercially available output circuit is the interface circuit 53 that provides to the CPU 50, or an intermediate register, if needed, an electrical output indication, on lines 66, of the amount of rotation of the shaft 63 of the stepper motor 61. The enabling device 54 includes a stepper motor 69. Its commercially available control circuit is the interface circuit 56. Input data to its commercially available stepper motor control circuit is on lines 72 from the CPU 50 or an intermediate register.

The output shaft 63 of the stepper motor 61 extends through a motor mounting plate 74. Affixed to this end of the shaft 63, a first member 76 of a slidable coupling 77 has a pair of laterally projecting pins 78 (one shown) secured to a reduced diameter portion 79. A second member 81 is slidably mounted on the portion 79, and receives the pins 78 in a pair of axially extending slots 83 (one shown). The second member 81 of the coupling 77 is movable axially while communicating rotary motion from the stepper motor shaft 63.

At its end 84 remote from the motor shaft 63, the second coupling member 81 receives and is affixed to a descending register setting shaft 85. The setting shaft 85 is movable axially from a locked position shown in FIG. 3 to a resetting position. In the locked position of the shaft 85, a descending register resetting gear 87 engages a fixed locking pin 89 secured to a fixed plate 91 in the meter. In this position, the gear 87 and shaft 85 are unable to rotate other than the very slight turning permitted by the clearance between the pin 89 and the gear teeth of the gear 87. In the resetting position of the shaft 85, the gear 87 has moved to the broken line position 87' shown in FIG. 3, where it engages a descending register gear 93. This gear resets the register 39 when turned, increasing the value on the descending register. Registers of the nature of the descending register 39 are known in the art, and indeed previous, manually resettable meters used descending registers of this kind, as well as the axially movable resetting shaft, the locking pin, and the shaft-mounted resetting gear for manual resetting by a postal worker. A descending register detent gear 94 affixed on the setting shaft 85 is engaged by a spring-biased pin 96. The pin 96 is urged radially inward to reside between and in engagement with teeth of the detent gear when the register has been set. The detent pin 96 urges the detent gear 94, the shaft 85 and the resetting gear 87 to a rotational position at which the gear 87 will pass smoothly back into engagement with the pin 89. The detent gear 94 and the detent pin 96 are also conventional in manually resettable postage meters of the kind that are carried to the Post Office to be manually reset by a postal employee.

Automatic resetting of the descending register 39 is begun by the stepper motor 69 moving the setting shaft 85 to the setting position to enable resetting of the register. When instructed by an input to its circuit 56, the motor 69 turns a lead screw 98 secured to an output shaft 99 of the motor. A lead screw nut 101 receives the lead screw 98 in threaded engagement. The nut 101 has secured thereto a pair of laterally extending pins 102 (one shown). A pair of levers 103 (one shown) is pivoted centrally at a fulcrum 106 on a mounting member 107. Slots 109 in the levers 103 receive the pins 102. A bushing 111 on the second member 81 of the coupling 77 has a pair of laterally projecting pins 112, one of which can be seen in FIG. 3. The bushing 111 is captive between shoulders formed by a pair of bosses 114 formed on the axially movable second member 81 of the coupling. One or both shoulders 114 can be a split ring of pliable metal enabling its being spread, placed over the movable coupling member 81, and closed. The second member 81 is rotatable with respect to the bushing. Each lever 103 has a slot 115 receiving one of the pins 112 of the bushing 111. When the CPU 50 authorizes resetting, an enabling signal is supplied to the stepper motor 69 via its circuitry 56 to drive the lead screw 98. In an iterative procedure described more fully below, the lead screw nut 101 is retracted towards the stepper motor 69 to pivot the levers 103 and drive the bushing 111, the axially movable member 81 of the coupling 77, and the setting shaft 85 of the meter to the left in FIG. 3. This, then, enables resetting of the descending register 39 by moving the resetting gear 87 into engagement with the descending register gear 93. The gear 87 is now turned an amount determined by an input to the stepper motor 61 via its circuit 52. When the output from the encoder 64, via its circuit 53, and the output line or lines 66, confirm to the CPU 50 that the shaft 63 of the stepper motor 61 has turned an amount corresponding to the amount of postage to be set into the descending register 39, the stepper motor 69 is signaled to rotate the lead screw 98, moving the nut 101 to the left to move the shaft 85 to the right, withdraw the setting gear 87 from the descending register gear 93, and once again lock the setting shaft 85 by engagement of the setting gear 87 with the pin 89. Thus the enabling mechanism 54 that includes the stepper motor 69 disables the resetting mechanism 51 that includes the stepper motor 61. Because the detent pin 96 is located between and in firm engagement with teeth of the detent gear 94, the resetting gear 87 is properly positioned to move onto the pin 89.

Figure 4:
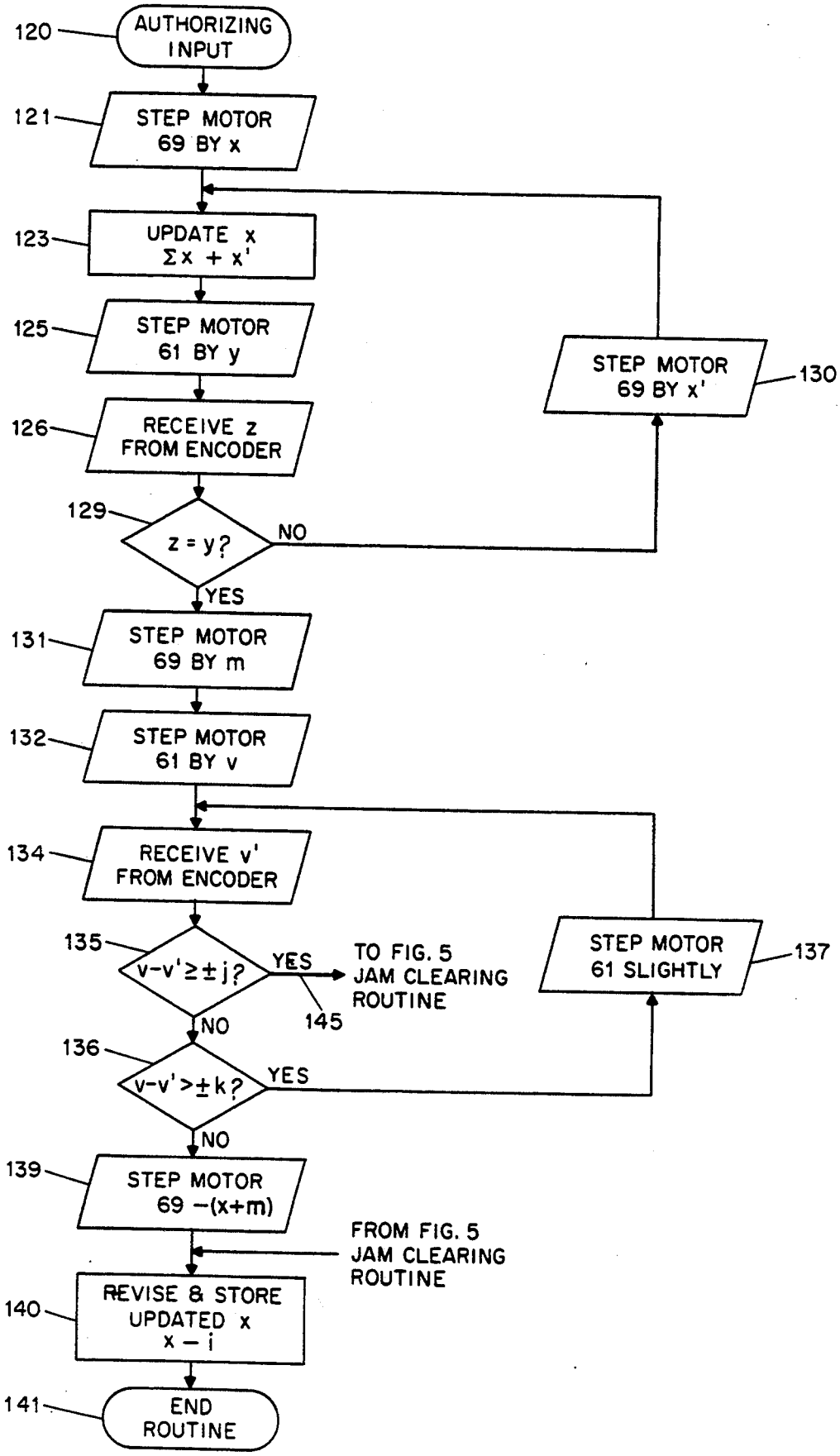
FIG. 4 is a flow chart illustrating, diagrammatically, the steps of a resetting subroutine effected by a CPU that is a part of the resetting device illustrated in FIGS. 1–3.

The CPU 50 has a routine for assuring that the setting shaft 85 has been moved sufficiently to cause the setting gear 87 to clear the pin 89 and engage the descending register gear 93 when resetting is to begin. The flow chart of FIG. 4 illustrates the routine. Once the resetting has been authorized, the routine starts at 120. The CPU 50, at 121, causes the electronics 56 of FIG. 3 of the enabling motor 69 to deliver a series of pulses corresponding to x steps in the enabling direction sufficient to move the gear 87 a distance known to be less than enough to remove the gear from the pin 89. At 123, the CPU 50 retains an indication of the number of steps in RAM. The CPU then causes, at 125, the electronics 52 of the resetting motor 61 to deliver a series of pulses sufficient to cause the motor 61 to turn y steps, through an angle known to be more than the angle that the gear 87 can turn while it is in engagement with the pin 89. The CPU receives z, the output from encoder 64 and its circuitry 53, at step 126. The CPU 50 then compares, at 129, the rotation that it has directed the setting motor 61 to effect with the actual amount of rotation as indicated to it by the encoder 64 and its associated circuitry 53. The CPU determines that the motor 61 has turned less than instructed and, by an output to the electronics 56 of the motor 69, instructs the motor 69 to move the gear 87 a further distance x', as indicated at 130. The CPU updates x, adding x' to the previously stored x in memory at 123, and again delivers to the circuitry 52 instructions to pulse the motor 61 a number y of pulses, at 125. Again the actual angle of rotation z is received, at 126, and compared, at 129, to the angle that the motor 61 was instructed to turn, and if z continues to be less than y, the preceding steps of causing motor 69 to turn x', adding x', instructing the motor 61 to turn y steps, receiving the actual steps z turned, and comparing are iterated, until the CPU learns that z=y and concludes that the gear 87 has cleared the pin 89. The CPU instructs the motor 69 to move the gear a further minimum clearance distance m as indicated at 131. The resetting gear 87 then is in engagement with the register gear 93, and should be clear of the pin 89.

When the CPU concludes that the gears 87 and 93 are engaged, the CPU delivers, at 132, to the resetting motor circuit 52 in FIG. 3, instructions to step the motor 61 through an angle of rotation that corresponds to the desired variable amount v of postage to be added to the postage remaining in the descending register. At 134, the CPU 50 receives the output v' from the encoder 64 and its circuit 53 at lines 66 representing the amount the motor 61 has actually turned. The CPU compares the two, v and v', at 135, to be sure that the correct amount of postage has been set into the register 39. If the actual rotation v' differs from the desired rotation v by less than an amount j, the CPU continues with the resetting routine. The CPU may determine whether the actual amount turned v' is within a smaller tolerance k of the desired amount v, at 136. If it is, then the resetting continues, but if it is not, as indicated by the "yes" line from the decision block 136, a slight further movement by motor 61 is effected at 137, the new encoder output v' is compared with the desired value v and this continues until v=v' within the tolerance k. Next, at 139, the CPU instructs the enabling stepper motor 69, via its electronics 56, to retract the gear 87 an amount equal to x, as updated at 123. For the next resetting, x is further updated, at 140, to be a slight amount i less than the total movement ($\Sigma x+x'$) that is the revised x so that initially the gear will not fully move off the blocking pin, but only a slight further movement will be needed. The resetting routine is then ended as indicated at 141. By this approach, the resetting device is unaffected by mechanical tolerances and wear of the pin 89, gear 87, and gear 93.

Another routine of the CPU 50 concerns the resetting shaft and the possibility it may become jammed during resetting. The jam clearing routine, illustrated in FIG. 5, detects the jamming, frees the jam, completes loading of postage, re-establishes the reverse axial movement of the resetting shaft, and updates the minimum clearance amount to prevent future jamming. The mechanism is subject to jamming in two ways: the axial movement of the resetting shaft may be insufficient, leading to re-engagement of the resetting gear with the blocking pin, or the movement may be excessive so as to cause thrust jamming, i.e. by axial movement of the gear too far, into contact with a part other than the descending register gear 93. In either case as inputs are directed to the stepper motor 61 to rotate the resetting shaft 85 and add postage, the actual rotation, if any, of the shaft will be less than the amount commanded, with the actual rotation amount being reported by the encoder 64. The method detects the jamming by comparing, at 135 in FIG. 4, the rotation v commanded to the rotation v' reported by the encoder. When these differ by more than a threshold amount, j, a jam is declared.

Figure 5:
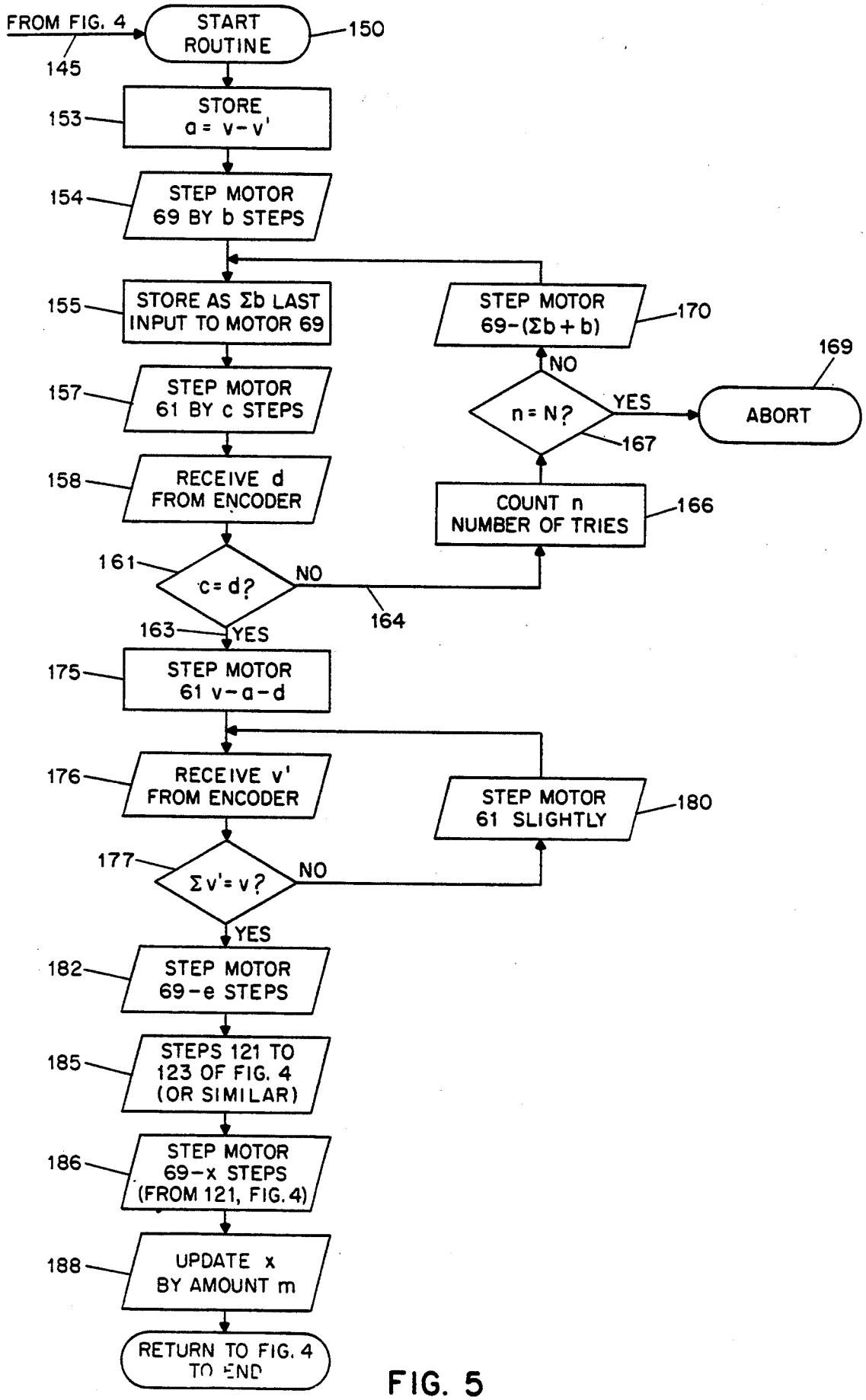
FIG. 5 is a flow chart illustrating, diagrammatically, the steps of a jam clearing subroutine effected by a CPU that is a part of the resetting device of FIGS. 1–3.

At 150 in FIG. 5, the jam clearing subroutine is initiated by receipt of the "yes" decision 145 from decision block 135 of FIG. 4. The jam clearing routine frees the resetting shaft by directing inputs to stepper motor 69 to cause axial movement of the shaft 85. First, at 153, the difference, a, between the desired resetting value of shaft rotation v and the actual accomplished shaft rotation v' is calculated and stored. A small axial shaft movement, corresponding to a number of steps b of the motor 69, is commanded in a selected direction, at 154. At 155 this input is stored as the current $\Sigma b$. Further rotation of stepper motor 61 is directed at 157, and the encoder 64 output d is noted at 158. If the commanded and reported rotation agree within a threshold, as detected at 161, the jamming is declared freed, as indicted at the "yes" path 163 from the decision block 161. The CPU routine then moves ahead to a subroutine ending set of steps described below. If the commanded and the accomplished rotation are not the same at 161, as indicated by the "no" path 164, the try is counted at 166. The number n of tries, one in this case, is compared to a desired maximum number of tries N, at 167. If n has not yet reached N, the opposite direction of shaft movement is selected, and an axial movement twice as great as b is directed, at 170. The input $\Sigma b$ to motor 69 is updated at 155. The amount of rotation is again checked at 157 and 158. Continued jamming, indicated by d being less than c at 161, increases the count n, and if n is still less than N, a direction reversal with three times the axial movement b occurs at 170. If jamming continues, reversal and four times the movement occurs, and so on, until either the jamming is freed or the cutoff number N of axial movements has been made. In the latter case, the mechanism is declared hopelessly jammed, and the resetting is aborted, at 169.

Once it is determined that the jam has been cleared, the amount of shaft movement $\Sigma b$, necessary to clear the jam, has been stored, at 155. Additional inputs are directed to the stepper motor 61, at 175, corresponding to the amount of postage yet to be added the desired amount v minus the less-than-complete resetting amount v', minus the amount d used to test whether the jam was cleared. The rotation command at 175, corresponding to the desired amount of postage v, can be verified at 177, by comparison with the encoder output received at 176, and the actual rotation can be corrected at 176, 177, and 180, if a slight error appears at 177.

Whenever jamming has occurred, it is presumed that the axial movement of the resetting shaft was inhibited and did not keep a one-to-one relationship with the inputs directed to the stepper motor 69; hence the proper amount of reverse axial movement of the shaft after resetting is unknown. This amount is re-established approximately by first commanding a reverse axial movement of the resetting shaft by an amount e assumed sufficient to cause re-engagement of the resetting gear with the blocking pin, but not large enough for complete retraction. This occurs at 182, where -e steps corresponds to e axial movement of the shaft in the gear retraction direction. Axial direction is then changed, and the shaft is moved so as to disengage the blocking pin, with rotational checks for engagement being made as previously disclosed at steps 123 to 130 of FIG. 4, indicated at 185 in FIG. 5. Eventually the gear is just clear of the pin and the axial location of the resetting shaft is now known to within a small error. At 186, inputs are directed to stepper motor 69 causing reverse axial movement of the resetting shaft. The amount of this movement, x steps, was determined earlier when ascertaining that the gear 87 had moved clear of the pin 89, at steps 121 to 130 Of FIG. 4. It is the accumulated movement that was determined to be necessary to take the shaft axially from its starting position to the point where the gear was clear of the blocking pin.

The likelihood of future jamming is reduced by noting in which axial direction the resetting shaft was moved when jamming was freed, and causing, at 188, updating of m to be used, at 131 in FIG. 4, in subsequent resetting, by adding or subtracting the amount judged adequate to prevent a future jam. The routine is ended by returning to the FIG. 4 resetting routine, which at 140 reduces the new m by i, the small amount that prevents the gear moving off of the pin initially in the next resetting. The resetting is then ended.

While a specific preferred embodiment of the invention has been described, it will be recognized by those skilled in the art that variations therein may be made without departure from the invention, as described in the appended claims. For example, other steps may be included in the FIG. 4 and 5 subroutines that are not important to this invention, but that accomplish other desired functions of the meter.

We claim:

1. A postage meter register setting device for use with a postage meter having at least one resettable mechanical register of available postage, and having mechanical setting means movable to reset the register; the setting device including a resetting motor having a movable mechanical output member, and means responsive to an authorizing input signal to electrically operate an enabling means for permitting setting and to cause operation of the motor to drive the register in a meter resetting direction via the mechanical output member and the mechanical setting means, the means responsive to an authorizing input signal being a central processing unit for controlling the operation of the enabling means and the resetting motor, the central processing unit being programmed to direct to the motor operating signals representative of a desired variable amount of postage to be added to the resettable mechanical register, the resetting motor being a stepper motor with control circuitry operatively connected to the central processing unit to turn an output shaft of the stepper motor an amount corresponding to the desired variable amount of postage as represented by the motor operating signals and an encoder coupled to the motor and operatively electrically connected to the central processing unit to provide information to the central processing unit indicative of the amount of rotation effected by the motor.

2. A postage meter register setting device for use with a postage meter having at least one resettable mechanical register of available postage, and having mechanical setting means movable to reset the register; the setting device including a resetting motor having a movable mechanical output member, electrically operable enabling means for movement from a position in which operation of the motor is blocked to a second position operatively connecting the motor to the register via the mechanical output member and the mechanical setting means, and means responsive to an authorizing input signal to electrically operate the enabling means and to cause the operation of the motor to drive the register in a meter resetting direction via the mechanical output member and the mechanical setting means, the means responsive to an authorizing input signal including a central processing unit for controlling the operation of the enabling means and the resetting motor, the central processing unit being programmed to direct to the motor operating signals representative of a desired variable amount of postage to be added to the resettable mechanical register, the central processing unit including a routine for determining that the enabling means has moved from the position in which operation of the resetting motor is blocked to the second position operatively connecting the motor to the register and the central processing unit including a routine for determining when the operation of the resetting motor to reset the register is prevented by jamming and for releasing the jammed condition or aborting resetting.

3. A postage meter register setting device for a mechanical postage meter having a printing means, a separate mechanical, resettable, descending register of available postage and movable means for mechanically resetting the descending register with a selected variable sum of additional postage available for subsequent settings of the printing means; the device comprising motive means for engaging and moving the movable means to reset the descending register, means for enabling the means for resetting to effect resetting of the descending register, and means responsive to a remotely originating authorizing input for activating the means for enabling, wherein the postage meter includes a descending register resetting shaft, the motive means for resetting the descending register includes a motor having an output shaft, an axially movable coupling on the output shaft adapted to couple the output shaft to the descending register resetting shaft, the means for enabling comprising means connected to the movable coupling to effect axial movement of at least a portion thereof.

4. The postage meter register setting device according to claim 3 wherein the postage meter descending register resetting shaft is axially movable to a descending meter resetting position, and the axially movable coupling portion is axially movable on the output shaft to axially move the descending register resetting shaft into the resetting position.

5. The postage meter register setting device according to claim 3 wherein the means connected to the movable coupling to effect axial movement comprises a collar receiving the coupling rotatably therein, the collar being captive between shoulders on the coupling to impart axial movement from the collar to the coupling, the means connected to the movable coupling comprising a linkage connected to the collar and movable to effect axial movement of the collar, and the means for enabling further comprising electrically operable drive means for moving the linkage, the collar, and the axially movable coupling portion.

6. The postage meter register setting device according to claim 5 wherein the electrically operable drive means of the means for enabling includes an electrical motor, a lead screw connected in driven relation to the motor, a lead screw nut threaded onto the lead screw and connected in driving relation to the linkage.

7. The postage meter register setting device according to claim 6 wherein the coupling is adapted to move axially on the resetting motor output shaft to move the descending register resetting shaft from a resetting blocked position to a resetting position at which rotational movement of the output shaft, the coupling, and the resetting shaft will effect resetting of the descending register.

8. A postage meter register setting device for a mechanical postage meter having a mechanical, resettable, descending register, a resetting gear adapted to rotate to reset the descending register, a rotatable and axially movable resetting shaft with an affixed gear located to mesh with the resetting gear in one axial location and located to engage a fixed locking member preventing rotation of the shaft and affixed gear in another axial location, the setting device including a resetting motor, an encoder coupled to the motor to indicate the amount of rotational movement of the motor, a coupling between the motor and the resetting shaft to impart rotational movement from the motor to the resetting shaft, resetting enabling means including electrically operable enabling means connected to impart axial movement to the resetting shaft to move the gear on the resetting shaft between engagement with the locking member and engagement with the resetting gear, control means for the motor and the electrically operable enabling means, the control means having a program routine for:

imparting limited axial movement to the resetting shaft in the direction of engagement of the gear on the resetting shaft and the resetting gear, applying an energizing input to the resetting motor corresponding to a predetermined amount of rotational movement that is greater than the rotational movement capable of being imparted by the resetting motor to the resetting shaft with the gear on the resetting shaft in engagement with the fixed locking member, detecting the amount of rotational movement indicated by the encoder, and imparting additional axial movement to the resetting shaft in the direction of gear engagement, when the encoder output indicates less rotational movement than corresponds to the input to the resetting motor.

9. The postage meter register setting device according to claim 8 further comprising means for introducing an input representative of a desired additional, variable amount of postage to be reset in the descending register, the control means being programmed to provide an input to the resetting motor corresponding to the amount of rotation of the resetting gear required to increase the available postage in the descending register by the desired variable amount after the encoder output has indicated that the resetting motor shaft has rotated the correct amount for the preceding input, whereby it is determined that the resetting gear and the blocking pin are disengaged.

10. The postage meter register setting device according to claim 9 wherein the control means has a further routine for determining that a jam has occurred preventing rotation of the gear on the resetting shaft by an amount representing the variable amount of postage, said routine including comparing a desired, commanded amount of rotation by the resetting motor with an amount of rotation indicated by an output by the encoder, moving the shaft axially in a first direction when the output indicated by the encoder is not sufficiently near or equal to the commanded amount of rotation, commanding a further rotation by the resetting motor, comparing a further output from the encoder, continuing the resetting when the further rotation and the further output are sufficiently near or equal, moving the shaft opposite the arbitrary direction a distance greater than the distance the shaft was previously moved in the arbitrary direction when the further rotation and the further output are not sufficiently near or equal, then again commanding a further rotation of the resetting motor, comparing the further rotation again with a further output from the encoder, continuing the resetting when the further rotation and the further output are sufficiently near or equal, and continuing axial movements of the shaft of increasing length and the resetting motor rotations and comparisons with the encoder output until a predetermined number of tries have been reached or the rotation is sufficiently near or equal to the encoder output, aborting the resetting when the predetermined number of tries has been reached, and continuing resetting when the rotation and the output are sufficiently near or equal.

11. The postage meter register setting device according to claim 9 wherein the control means program iterates the procedure of imparting limited axial movement to the resetting shaft axially, applying an energizing input to the resetting motor, and detecting the amount of rotational movement until the detected rotational movement corresponds to the preceding resetting motor input, and subsequent to resetting, the control means program routine further applying to the electrically enabling operable means an input corresponding to reverse axial movement of the resetting shaft an amount equal to the total axial movement during the iterated axial movement toward engagement of the gears.

12. The postage meter register setting device according to claim 11 wherein the control means program routine includes updating, for the next resetting, the amount of limited axial movement to be applied initially to the resetting shaft to equal slightly less than the sum of the axial movements of the resetting shaft that effected gear engagement in this resetting.

13. The postage meter register setting device according to claim 11 wherein the resetting motor is a first stepper motor and the electrically operable enabling means includes a second stepper motor, the control means for the resetting motor and the electrically operable enabling means comprising means for causing electrical inputs to be applied to the stepper motors, including a central processing unit for controlling the electrical inputs to be applied to determine the amount of rotation of the motors.

14. A method of resetting a mechanical postage meter having a mechanical descending register comprising the steps of:

a) providing a resetting gear axially movable from engagement with a rotation blocking member to engagement with a descending register gear, b) providing an electromechanical enabling mechanism preventing resetting of the register absent authorization, c) providing an electromechanical motive resetting mechanism operative to add to the register a desired variable amount of postage when enabled by the enabling mechanism, d) effecting axial movement of the resetting gear towards engagement with the descending register gear by the enabling mechanism, e) directing to the electromechanical motive resetting mechanism an input sufficient to turn the resetting gear an amount corresponding to the desired value of postage to be introduced into the register, f) providing an indication of the amount of rotation actually accomplished by the resetting gear, g) comparing the accomplished rotation to the rotation corresponding to the desired value, h) when the amount of rotation indicated as actually accomplished is not sufficiently near or equal to the rotation corresponding to the desired value, moving the resetting gear axially with the enabling mechanism, i) directing to the electromechanical motive resetting mechanism an input sufficient to turn the resetting gear a test amount, j) providing an indication of the resultant actual amount of test turning of the resetting gear, k) comparing the desired test amount of turning with the resultant actual amount of turning, and l) when the resultant actual amount of turning is sufficiently close to or equals the desired test amount, completing resetting by rotating the resetting gear an amount corresponding to the desired value of postage by the electromechanical motive resetting mechanism and returning the resetting gear into engagement with the rotation blocking member by the electromechanical enabling mechanism.

15. The method according to claim 14 further comprising the steps of continuing directing movement of the resetting gear axially with the enabling mechanism increasing amounts in opposite directions, continuing directing to the electromechanical motive resetting mechanism an input sufficient to turn the resetting gear a test amount, and continuing comparing of the desired test amount with the resultant actual amount of turning, for as long as the comparing indicates that the resultant actual turning is not sufficiently close or equal to the last test amount of turning so as to indicate an unjammed condition or until a predetermined number of iterations of directed gear movement, test turning and comparing is reached.

16. The method according to claim 15 further comprising the step of using the amount of gear movement necessary to clear a jam as indicated by a successful comparison of the desired amount of test turning and resultant actual amount, to correct the initial axial gear movement to be effected by the enabling mechanism in the next resetting.

17. The method according to claim 15 further comprising the step of storing the amount of turning accomplished initially by the resetting gear when directed to turn an amount corresponding to the desired value of postage to be introduced, and after a jam has been cleared and indicated by a successful comparison of the desired amount of test turning, the step of completing resetting includes correcting the amount of further turning of the resetting gear based on the amount of turning accomplished initially.

18. The method according to claim 17 wherein the step of correcting the amount of further turning to be accomplished further comprises modifying the amount of further turning based on the amount of test turning effected to clear a jam as indicated by the successful comparison.

19. The method according to claim 15 further comprising the steps of correcting the axial location of the gear after a jam has been cleared including directing movement of the resetting gear axially by the enabling mechanism an amount sufficient to move the resetting gear into rotation blocking engagement with the rotation blocking member, directing movement of the resetting gear axially by the enabling mechanism towards disengagement with the blocking member an amount insufficient to cause the disengagement, directing a rotation of the resetting gear by the resetting mechanism an amount greater than can be accomplished while the resetting gear engages the blocking member, providing an indication of the amount of rotation actually accomplished by the resetting gear, comparing the accomplished rotation to the rotation directed, further axially moving the resetting gear when the actual rotation is less than the rotation directed, directing a rotation of the resetting gear by the resetting mechanism an amount greater than can be accomplished while the resetting gear engages the blocking member, providing an indication of the amount of rotation actually accomplished by the resetting gear, comparing the accomplished rotation to the rotation directed, further axially moving the resetting gear when the actual rotation is less than the rotation directed, when the actual rotation continues to be less than the rotation directed continuing the steps of further axially moving, directing a rotation, providing an indication, and comparing until the accomplished rotation is substantially equal to the rotation directed, then moving the gear axially into engagement with the rotation blocking member an amount previously determined to be sufficient to move the gear into and out of engagement with the rotation blocking member and slightly more than an amount stored for moving the gear axially in the direction away from disengagement with the rotation blocking member for use in the next resetting.

20. The method according to claim 19 further comprising the step of correcting the amount stored for moving the gear axially for use in the next resetting by varying that amount as previously stored by an amount related to the axial movement used to clear the jam.

21. A method of resetting a mechanical postage meter by increasing total available postage in a mechanical descending register including the steps of:

(a) providing an electromechanical enabling mechanism preventing resetting of the register absent authorization, (b) providing an electromechanical motive mechanism operative to add to the register a desired variable amount of postage when enabled by the enabling mechanism, (c) upon receipt of an authorizing signal, sending to the electromechanical enabling mechanism an electrical input causing the enabling mechanism to enable resetting of the register, (d) providing to the electromechanical motive mechanism an electrical input indicative of the variable amount of postage to be added to the register to cause the motive mechanism to mechanically set that variable amount of postage into the register, and (e) sending to the enabling mechanism an electrical input causing the enabling mechanism to one again prevent resetting of the register, wherein resetting of the register comprises movement of a resetting gear from engagement with a blocking member to engagement with a register gear, and turning the resetting gear to cause turning of the register gear an amount corresponding to the addition of the desired variable amount of postage to the register.

22. The method according to claim 21 including jam detection comprising the steps of:

providing an indication of the amount of rotation actually accomplished by the resetting gear, comparing the indication of the accomplished rotation to the desired amount of turning corresponding to the desired variable amount of postage, when the accomplished rotation is not sufficiently near or equal to the desired turning, moving the resetting gear a further amount in a first direction the same or opposite said movement from engagement with a blocking member, turning the gear an amount, again providing an indication of the amount of rotation, again comparing the indication of the amount of rotation and the amount of gear turning intended, when the indication of the amount of rotation is sufficiently near or equal to the amount of gear turning intended, continuing the resetting.

23. A method of resetting a mechanical postage meter by increasing total available postage in a mechanical descending register including the steps of:

(a) providing an electromechanical enabling mechanism preventing resetting of the register absent authorization, (b) providing an electromechanical motive mechanism operative to add to the register a desired variable amount of postage when enabled by the enabling mechanism, (c) upon receipt of an authorizing signal, sending to the electromechanical enabling mechanism an electrical input causing the enabling mechanism to enable resetting of the register, (d) providing to the electromechanical motive mechanism an electrical input indicative of the variable amount of postage to be added to the register to cause the motive mechanism to mechanically set that variable amount of postage into the register, (e) sending to the enabling mechanism an electrical input causing the enabling mechanism to one again prevent resetting of the register, (f) moving the resetting gear axially a distance insufficient to disengage the resetting gear from the blocking member, (g) imparting a rotation causing input to the electromechanical motive mechanism corresponding to a rotation greater than can be accomplished while the resetting gear engages the blocking member, (h) providing an indication of the amount of rotation actually accomplished by the resetting gear, (i) comparing the accomplished rotation to the rotation represented by the rotation causing input, (j) further moving the resetting gear axially when the actual rotation is less than the rotation represented by the rotation causing input, and (k) repeating steps (g), (h), (i) and (j), until the actual rotation equals the rotation represented by the rotation causing input, then (l) providing an input to the electromechanical motive mechanism corresponding to a rotation of the register gear equal to the amount of postage to be added to the register.

* * * * *